US007413616B2

(12) United States Patent
Breiling et al.

(10) Patent No.: US 7,413,616 B2
(45) Date of Patent: Aug. 19, 2008

(54) ACTIVE RINSE SHIELD FOR ELECTROFILL CHEMICAL BATH AND METHOD OF USE

(75) Inventors: Patrick Breiling, Portland, OR (US); John D Rasberry, Sherwood, OR (US); Steve C Schlegel, Newberg, OR (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 11/582,694

(22) Filed: Oct. 19, 2006

(65) Prior Publication Data

US 2007/0102022 A1 May 10, 2007

Related U.S. Application Data

(62) Division of application No. 10/390,373, filed on Mar. 17, 2003, now Pat. No. 7,146,994.

(51) Int. Cl.

| | |
|---|---|
| ***E05D 15/02*** | (2006.01) |
| ***E06B 3/32*** | (2006.01) |
| ***E06B 3/34*** | (2006.01) |
| ***E06B 7/00*** | (2006.01) |

(52) U.S. Cl. ..... 134/32; 134/42; 49/41; 49/44; 49/68; 49/73.1; 251/212

(58) Field of Classification Search ..... 134/10, 134/34, 183, 143, 200; 49/41, 42, 44, 68, 49/73.1, 74.1, 77.1, 79.1, 80.1, 320, 371; 251/212

See application file for complete search history.

(56) References Cited

U.S. PATENT DOCUMENTS

| | | | | |
|---|---|---|---|---|
| 916,484 | A * | 3/1909 | Pihl | 454/271 |
| 4,118,862 | A * | 10/1978 | Hensel | 30/124 |
| 4,188,862 | A * | 2/1980 | Douglas, III | 454/324 |
| 5,159,274 | A | 10/1992 | Groshong | |
| 5,357,645 | A | 10/1994 | Onodera | |
| 5,806,543 | A | 9/1998 | Ohmi | |
| 5,899,216 | A | 5/1999 | Goudie et al. | |
| 6,010,113 | A * | 1/2000 | Rotering | 251/212 |
| 6,050,275 | A * | 4/2000 | Kamikawa et al. | 134/105 |
| 6,164,297 | A | 12/2000 | Kamikawa | |
| 6,211,055 | B1 | 4/2001 | Peng et al. | |
| 6,227,947 | B1 | 5/2001 | Hu et al. | |
| 6,248,670 | B1 | 6/2001 | Hung et al. | |

(Continued)

*Primary Examiner*—Joseph L. Perrin
*Assistant Examiner*—Joy Watson
(74) *Attorney, Agent, or Firm*—DeLio & Peterson, LLC; Robert Curcio

(57) ABSTRACT

An active rinse shield designed to protect electrofill chemical baths from excessive dilution during rinse sprays on the semiconductor wafer. The shield uses overlapping blades to cover the bath, making a physical barrier between the bath chemistry and the wafer rinse water. The blades are interconnecting ribs that actuate around a common pivot axis. A linear mechanical actuator controls the blade movement, moving the top-most blade, which in turn, moves an adjacent lower blade. Each upper blade is interconnected to an adjacent lower blade by upper and lower ledges, a pivot boss and interlocking cut, and a curved ledge on each blade's body surface. The interconnecting features allow the blades to move one another out for extension or in for retraction. The interlocking blades are inclined above one another, forming grooves to redirect the rinse water away from the chemical bath.

8 Claims, 5 Drawing Sheets

U.S. PATENT DOCUMENTS 6,328,872 B1 12/2001 Talieh et al.
6,416,647 B1 7/2002 Dordi et al.
6,471,845 B1 10/2002 Dukovic et al.
6,474,880 B2 11/2002 Toyoda et al.
6,508,258 B1 1/2003 Lorimer
6,712,335 B1 * 3/2004 Naughton ..... 251/212

* cited by examiner

ACTIVE RINSE SHIELD FOR ELECTROFILL CHEMICAL BATH AND METHOD OF USE

This application is a divisional of U.S. patent application Ser. No. 10/390,373 entitled "Active Rinse Shield For Electrofill Chemical Bath And Method Of Use", filed on Mar. 17, 2003.

BACKGROUND OF THE INVENTION

1. Field of the Invention

The present invention relates generally to the field of wet chemical processing, and more specifically to an apparatus for controlling wafer rinse water from entering an electrofill chemical bath.

2. Description of Related Art

Machines for cleaning and processing wafers in the electronics industry are generally well known. Conventional processes involve plating a metal layer on a semiconductor wafer surface using a plating apparatus. One goal of wafer plating is to uniformly fill the holes and trenches with a conductive material. Thin film plating of copper into sub-micron holes and trenches has become more difficult in ULSI chip processing, particularly when the feature size is below 0.25 μm. In the field of chemical processing, and chemical plating in particular, it is important that the composition and concentration of various constituents be controllable. This includes the integrity and consistency of the chemical bath constituents and concentrations used for plating. After each processing step, it is often desirable to thoroughly clean, rinse, and dry the workpiece to ensure that debris is removed from the workpiece. Thus, methods and apparatus for cleaning, rinsing, and drying wafers have been made available in the art to minimize wafer damage and process degradation. For example, in a wet chemical deposition process, after a substrate is treated with chemicals, it is rinsed, generally in a de-ionized water spray although other post-treatments are used, such that the chemicals are washed off the substrate by the spray shower. Conventionally, in a wet process of semiconductor fabrication where the de-ionized water spray rinse is performed in the same tool as the chemical bath, this causes the problem of diluting the chemical bath with excess water runoff. In an electrofill tool, a wafer is generally placed into copper-acid bath chemistry where copper is plated to the wafer surface using electric current. The need to rinse wet chemical fluids is unique to the electrolytic process. Both before and after a plating process, the wafer surface is rinsed with water in the same tool where the chemical bath is the lowest chamber. If too much of this water enters the copper-acid bath, it will cause dilution of the chemistry, which must be controlled tightly to maintain uniform plating. Similarly, a sulfuric acid bath is sometimes used to remove organics from the wafer. Again, rinsing the wafer in a chamber above a sulfuric acid bath would dilute the acid bath. Thus, a portion of the rinse needs to be deflected from the bath in order to maintain the bath's original chemical concentration. Furthermore, since there are at least two steps in a deposition process to introduce de-ionized water, pre- and post-treatments, there are at least two opportunities for dilution, which must be mitigated. Generally, a pre-rinse limits impurities and defects from forming on the deposition surface, and a post-rinse, performed after deposition, decreases the corrosive effect on the wafer.

The present invention contemplates a device for shielding the chemical bath from dilution during the rinse process steps in an electrofill tool where the rinsing occurs in the same apparatus as the plating.

Bearing in mind the problems and deficiencies of the prior art, it is therefore an object of the present invention to provide an apparatus for limiting the dilution of a chemical bath due to rinse washes on wafers in an electrofill tool.

It is another object of the present invention to provide an apparatus for controlling the chemistry of a chemical bath.

A further object of the invention is to provide an apparatus that maintains uniform plating chemistry during electrofill deposition.

It is yet another object of the present invention to provide an apparatus to facilitate pre- and post- rinses during wet-chemistry deposition.

Still other objects and advantages of the invention will in part be obvious and will in part be apparent from the specification.

SUMMARY OF THE INVENTION

The above and other objects, which will be apparent to those skilled in the art, are achieved in the present invention, which is directed to, in a first aspect, an apparatus for shielding a first fluid from entering a chemical bath of a second fluid when the first fluid is sprayed over the bath, the apparatus comprising: a frame having a periphery and a pivot axis; a plurality of blades each sharing the pivot axis on the frame; a mechanical actuator having a movable arm adapted to drive the plurality of blades about the pivot axis, such that the blades shield the bath when the apparatus is in a closed position, and stack on each other when the apparatus is in an open position. The plurality of blades includes at least one blade attached to the mechanical actuator arm. A coupler is placed between at least one blade and the actuator arm. The design further comprises a torque-transferring feature cut into the at least one blade, the feature adapted to fit the coupler such that the actuator arm drives the plurality of blades in a clockwise or counterclockwise rotational direction about the pivot axis. A linear pneumatic or electrical device having the arm extend and retract in a linear motion is used to achieve rotational motion through the torque-transferring feature. The plurality of blades have a predetermined curvature and a length extending from the pivot axis to the periphery of the frame at discrete locations where each of the plurality of blades meets the periphery when the apparatus is in the closed position. The blades interconnect and overlap, having an upper ledge and a lower ledge, such that the upper ledge of a lower blade contacts the lower ledge of an adjacent upper blade during blade movement. Each of the plurality of blades includes a pivot boss on a first side and a lower pivot interlock cut on a second side, such that the pivot boss of a lower blade connects with the pivot interlock cut of an upper adjacent blade, causing the lower blade to move with the adjacent upper blade. The pivot boss on the lower blade further comprises a ledge adapted to contact the pivot interlock cut on the adjacent upper blade when the adjacent upper blade moves relative to the lower blade. The blades are also designed with a curved ledge on the bottom of an upper blade interconnecting with a curved ledge on the top of an adjacent lower blade, causing the upper blade and the lower blade to move relative to one another, and prohibiting the first fluid from entering the bath when the apparatus is in the closed position.

In a second aspect, the present invention is directed to an apparatus for shielding a chemical bath from fluid treatment of a semiconductor wafer situated over the bath during the treatment, the apparatus comprising: a frame having a periphery and a pivot axis; a plurality of blades each sharing the pivot axis on the frame; a mechanical actuator having a movable arm adapted to drive the plurality of blades about the pivot axis, such that the blades shield the bath when the apparatus is in a closed position, and stack on each other when the apparatus is in an open position; at least one of the plurality of blades attached to the mechanical actuator arm; a coupler between the at least one blade and the actuator arm; and, a torque-transferring feature cut into the at least one blade, the feature adapted to fit the coupler such that the actuator arm drives the plurality of blades in a clockwise or counterclockwise rotational direction about the pivot axis. Each of the plurality of blades comprises an upper ledge and a lower ledge, such that the upper ledge of a lower blade contacts the lower ledge of an adjacent upper blade during blade movement.

In a third aspect, the present invention is directed to a method for shielding an electrofill chemical bath from a fluid rinse treatment of a semiconductor wafer, the wafer situated over the bath during the rinse, the method comprising: attaching a shield over the bath, the shield having a frame with a pivot axis and a plurality of overlapping, interlocking blades connected to the pivot axis; connecting a mechanical actuator having an actuator arm to at least one of the plurality of overlapping, interlocking blades through the pivot axis; and closing the shield by rotating the plurality of overlapping, interlocking blades in a first direction over the bath; applying the rinse to the wafer; draining the fluid off the shield for subsequent collection; and opening the shield by rotating the plurality of overlapping, interlocking blades in a direction opposite the first direction such that the blades stack upon each other on one side of the frame.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-7 of the drawings in which like numerals refer to like features of the invention.

The present invention introduces an active rinse shield to prevent wafer rinse water from entering an electrofill chemical bath. The active rinse shield is a mechanical shield that is configured to work in an electrofill bath multilevel chamber, where the rinse spray on the wafer is performed over the chemical bath. Typically, a plating layer is deposited on the underside of the wafer, the wafer side facing the chemical bath. The chemical bath and rinse mechanism are part of the plating cell or deposition module, which enhances the throughput of the tool, but requires an in-situ configuration for performing the rinse step. By closing the active rinse shield during the rinse portion of the process, the amount of chemical dilution of the electrofill chemical bath is significantly reduced. Furthermore, the deflected rinse spray is redirected by the active rinse shield away from the chemical bath for disposal or subsequent filtering and reuse.

Figure 1:
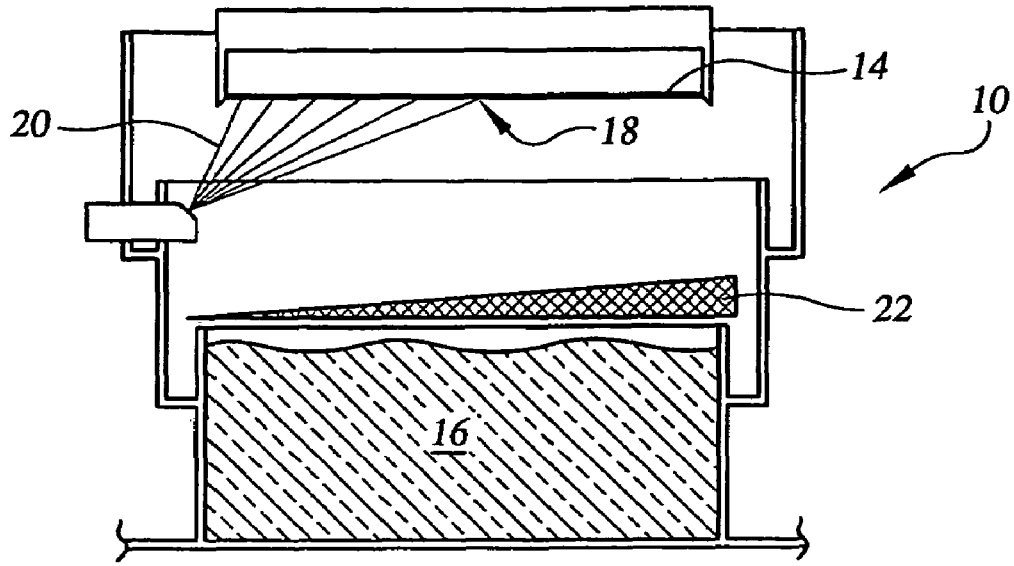
FIG. 1 is a schematic of an electrofill tool employing an active rinse shield.

An electrofill tool 10 employing the active rinse shield 22 of the present invention is depicted in FIG. 1. The electrofill tool 10 places a wafer 14 into a chemistry bath 16, typically a copper-acid bath chemistry although other chemistries may certainly be employed by this configuration. The electrofill tool is a round multilevel chamber, where the chemical bath 16 is the lowest chamber. The tool is configured to deliver a rinse 20 in the upper chambers. In the case of a copper-acid bath chemistry, copper is plated to the wafer surface when the bath is subjected to an electrical current. Both before and after the plating process, the wafer surface 18 is rinsed with water 20. If too much of this water enters the copper-acid bath, it causes dilution of the chemistry, which must be controlled tightly to maintain subsequent uniform plating. Prior electrofill tool configurations, where the rinse application is performed in the same column as the plating application, did not prevent the rinse water from entering the bath after spraying the wafer. A cross-section of active rinse shield 22 is shown placed over the chemical bath 16. An active rinse shield has been designed at 15 to 16 inches in diameter; however, other diameters are clearly available, dependent only upon the size of the chemical bath required to be covered.

The active rinse shield employs overlapping blades to cover the bath when it is extended. This makes a physical barrier between the bath chemistry and the wafer rinse water. The blades actuate around a common pivot axis or single rotation point, rotating to an extended position for bath coverage and to a retracted position for the wafer carrying apparatus to pass by and enter the bath before or after a rinse cycle. The single rotation point is the only point of attachment for the blades.

Figure 2:
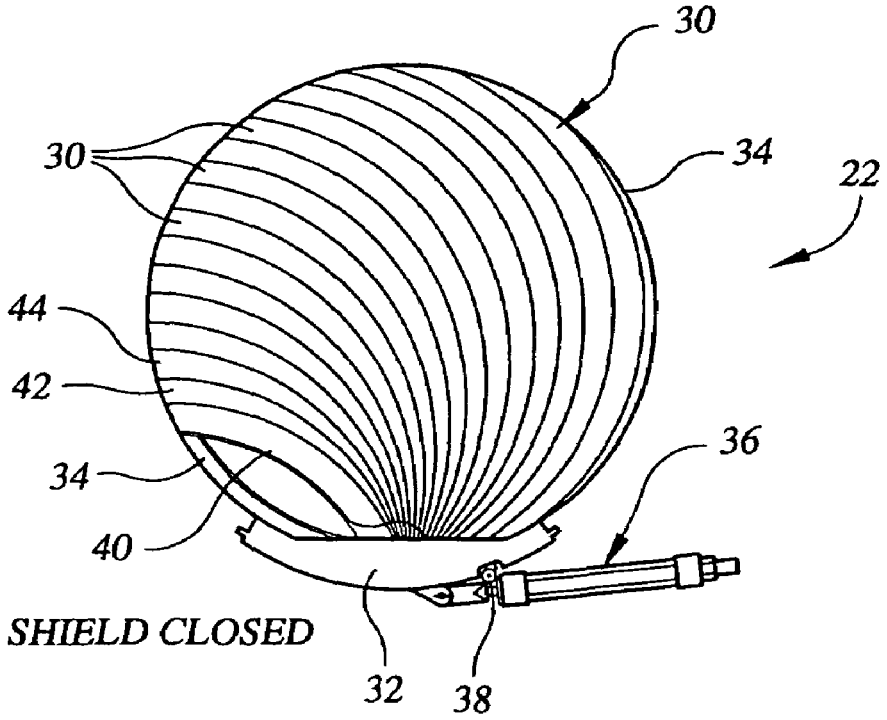
FIG. 2 depicts the active rinse shield of the present invention in its extended or closed state.

FIG. 2 depicts the active rinse shield 22 of the present invention in its extended or closed state. Several overlapping blades 30 are depicted. The blades 30 pivot about the common axis 32 to cover the circular area outlined by the shield's frame 34. Although a circular frame is preferred, other shapes may be adapted to accommodate the geometry of the electrofill tool chamber. Each blade may be considered a cantilever beam, solid enough not to bend under the applied forces or during subsequent motion. The blades are actuated by a mechanical actuator 36, having an arm 38 that moves an initial or top blade 40 from a closed to an open position, and back again. The actuator 36 is preferably a pneumatic or electrical cylinder having a linkage design. A linear actuator is most preferable since rotational motion can be formulated from translational motion, and the linear device represents a significant design cost savings. As discussed below, the translational motion is effectuated by a number of design implementations including keyed grooves in the blades. All the blades are interconnected, such that the top blade 40, driven by the actuator 36, drives the next adjacent blade or rib 42, which in turn drives a subsequent blade or rib 44 adjacent to it, and so on. In their extended or closed position, the interlocking blades form a seal to prohibit de-ionized rinse water from entering the chemical bath. The blades are fabricated from material that is chemically compatible with the constituents of the chemical bath, including sulfuric acid. Preferably, the blades are made of a polymer with enough mechanical strength to perform the required movements initiated by the actuator.

Figure 3A:
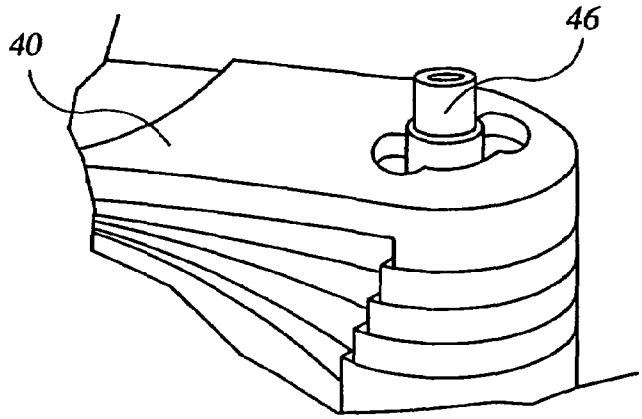
FIG. 3A depicts an overhead view of a top blade having a torque-transferring feature cut therethrough.
Figure 3B:
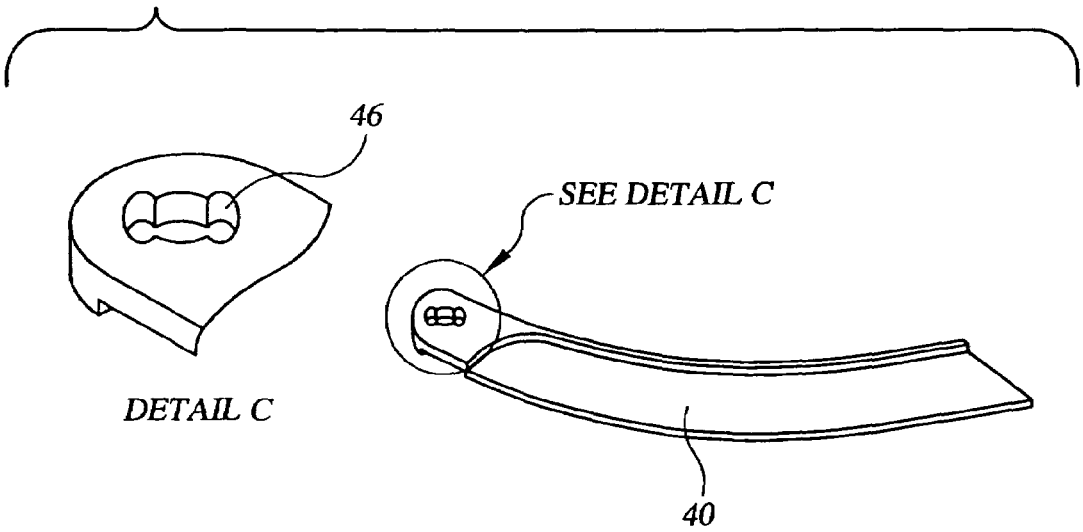
FIG. 3B depicts a detailed schematic of the torque-transferring feature on the top blade.
Figure 3C:
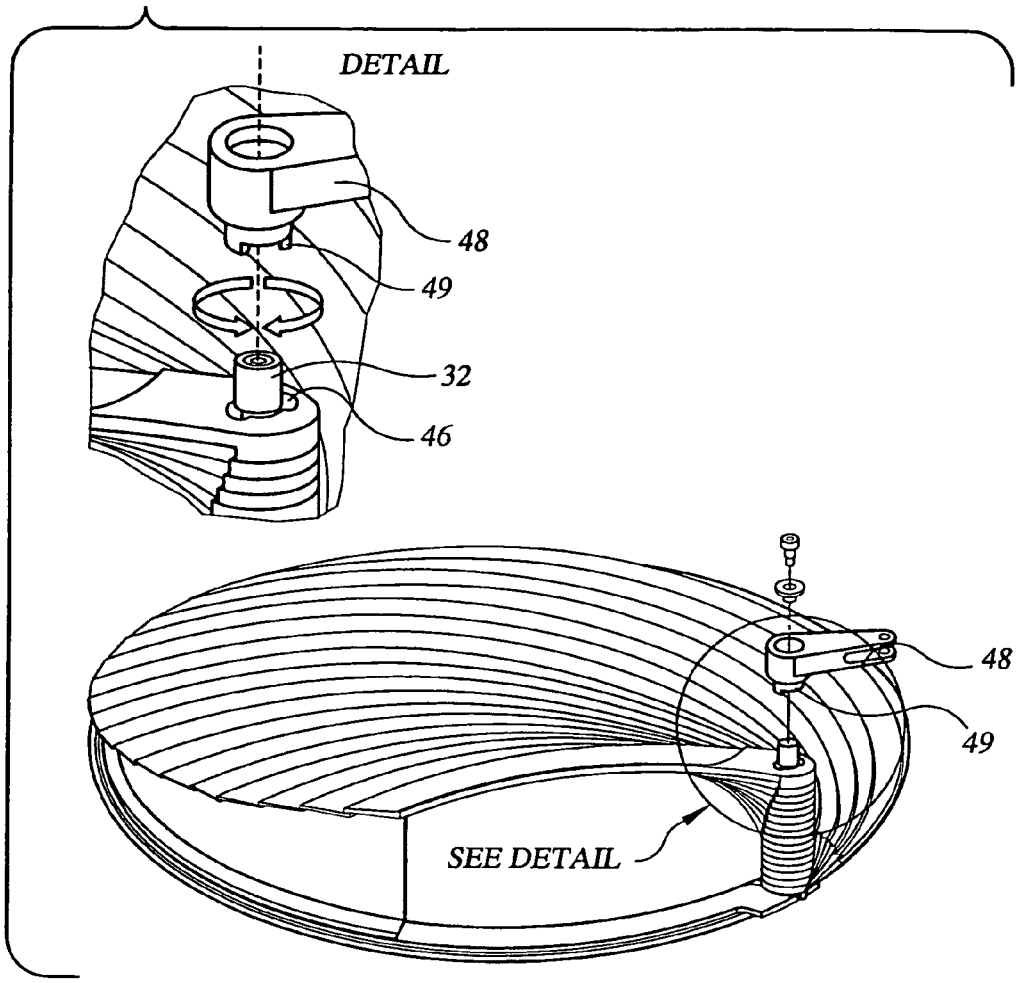
FIG. 3C is a detailed schematic of the actuator coupler including a shaped fit insert for the torque transferring feature
Figure 4:
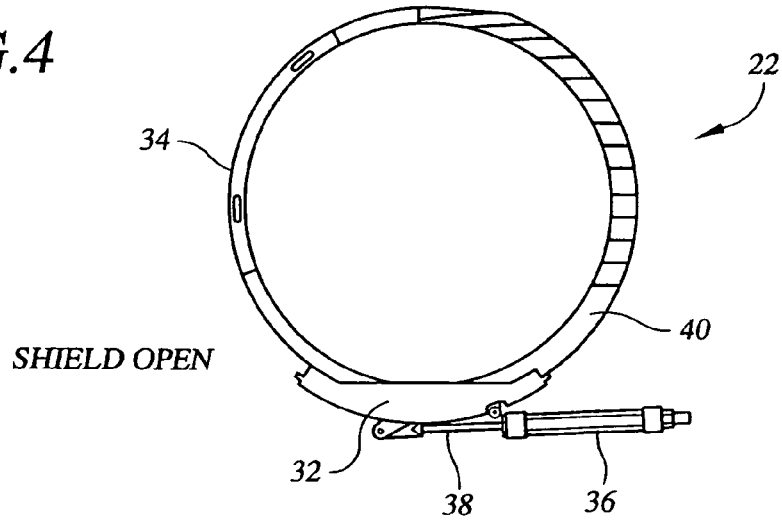
FIG. 4 depicts the active rinse shield in its retracted or open position.
Figure 5:
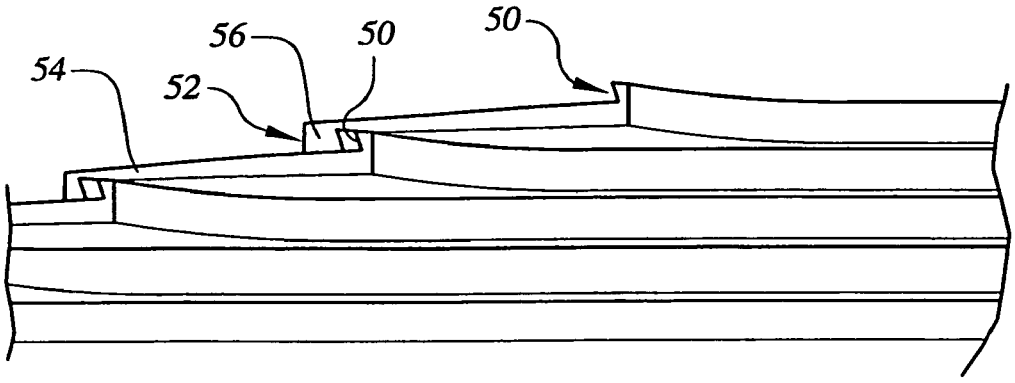
FIG. 5 depicts a cross-sectional view of overlapping blades showing interconnecting upper and lower ledges.
Figure 7:
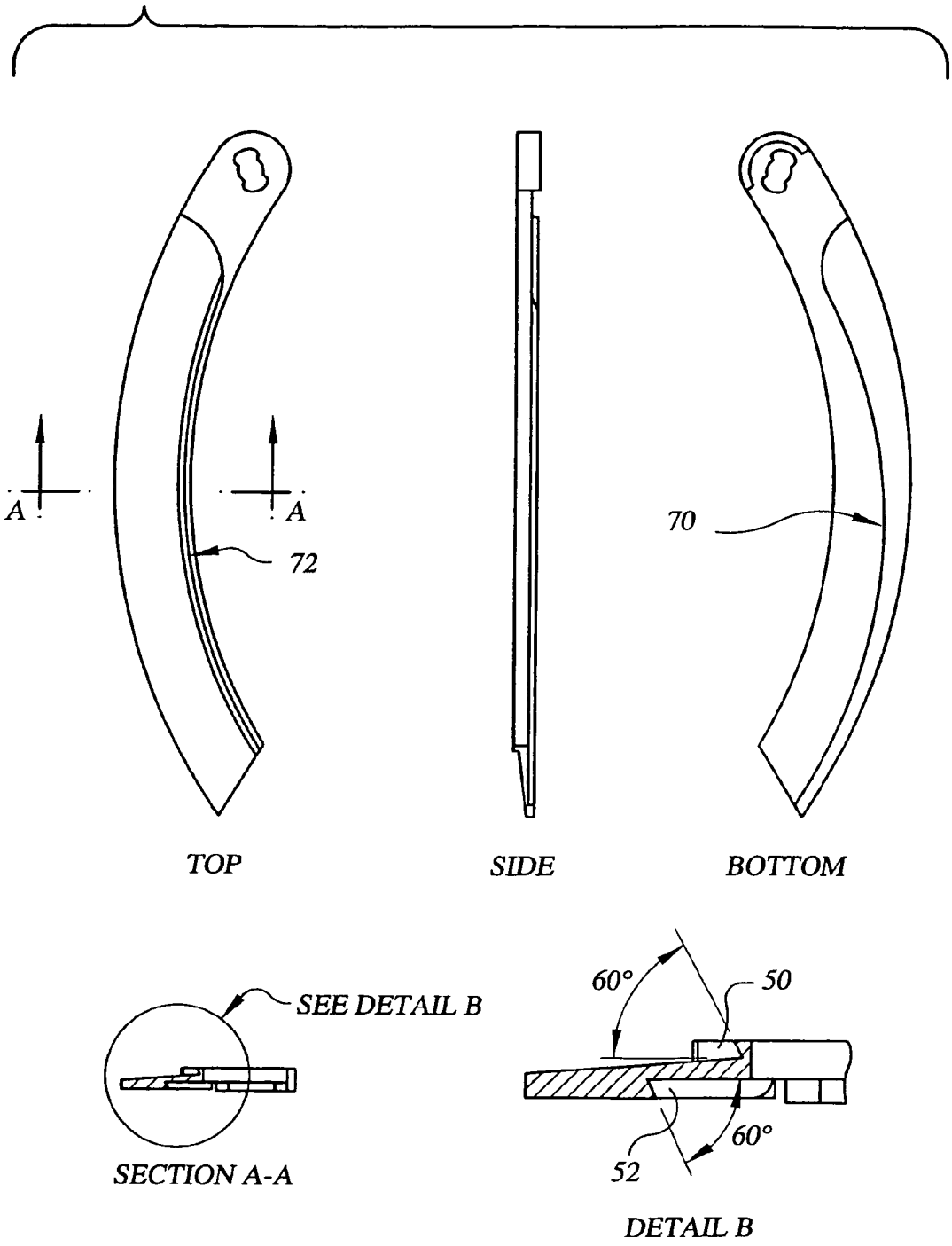
FIG. 7 depicts a blade having an interlocking curved ledge on its body surface.

The top blade 40 is turned with a coupler 48 between the actuator and the blade. The blade is designed with a torque-transferring feature 46 cut into it, as shown in FIG. 3A. The blades are shown in a stacked or open position in FIG. 3A. FIG. 3B depicts a detailed schematic of the torque-transferring feature 46 on top blade 40. As shown in FIG. 3C, the actuator coupler 48 includes a shaped fit 49 that inserts within the torque transferring feature 46, allowing the actuator to drive the top blade in either rotational direction about the shaft or axis 32 from which the blade pivots. FIG. 3C depicts the blades in their extended or closed position. The blades are shown stacked upon one another at axis 32. When actuator arm 38 is extended, the coupler 48 rotates about the pivot point, causing the shield to retract or open. FIG. 4 depicts the active rinse shield in its retracted or open position with actuator arm 38 extended. When the top blade is driven in one direction or the other, additional design features are employed to initiate the rotational movement of the subsequent blades below. As depicted in FIG. 5, each blade is designed with an upper ledge 50 and a lower ledge 52. When the shield is moved into a closed or extended position, the lower ledge 52 on an upper blade 56 catches, or interconnects with, the upper ledge 50 on an adjacent lower blade 54, causing the lower blade 54 to move out with the upper blade 56. Preferably, the curvatures of the upper and lower ledges are the same. This motion causes the shield blades to fan out over its circular area and effectively block rinse water from falling into the chemical bath. Preferably, the blade ledge angle is sixty degrees or greater. A detailed view of the blade ledges 50, 52 having angles approaching sixty degrees is shown in FIG. 7.

Figure 6:
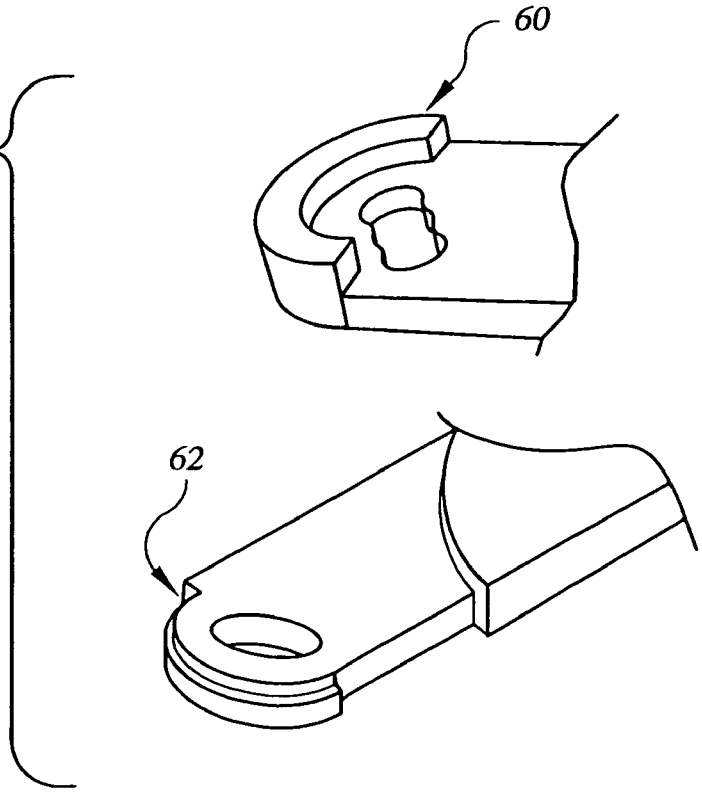
FIG. 6 depicts an overhead view of a pivot boss and pivot interlock cut of a blade.

At the pivot of each blade, there is an additional feature that drives the adjacent blade below. As depicted in FIG. 6, a pivot boss 60 representing a ledge or flange on the pivot is designed at the pivot point of each blade. The pivot boss 60 interacts and interconnects with a pivot interlock cut 62 from the lower blade. The pivot boss 60 fits into the interlock cut in the blade below, and when turned, the pivot boss hits the end of the cut on the lower blade, causing the lower blade to move in conjunction with the adjacent blade above. The angle the blades move before grabbing or interconnecting with the blade below is controlled by the total angles of the pivot boss and pivot interlocking cut relative to one another. Using the pivot boss—pivot interlocking cut feature, any upper blade will force the adjacent lower blade to move with it. Preferably, the curvature of the upper and lower ledge features are identical. Because of the interconnecting nature of the blades, this process will continue until all blades are engaged.

The reverse of this process occurs to move the blades in the open or retracted position. The mechanical actuator arm extends forcing the blades to move about the pivot axis, and causing the blades to ultimately line up directly on top of one another when the shield is completely open, as depicted in FIG. 3C. By stacking the blades during retraction, the shield's overall spacing is reduced, minimizing the impact of adding an active rinse shield to the electrofill assembly.

The ledge on the bottom of an upper blade or rib 70 is curved and designed to match a curved ledge on the top of a lower blade or rib 72, enabling each ledge to achieve the maximum amount of interlocking between each blade when the blades are in motion. FIG. 7 depicts the curved ledges 70, 72 on a blade's body surface. The preferred curvature of each ledge is the radius at which the ledge matches the radius of the part geometry.

In the shield's closed or extended state, the overlapping blades create a ribbed or grooved structure which captures and funnels the de-ionized water spray to a collection point. As a result of their overlapping nature, the blades are situated at an incline, which facilitates the redirection of the rinse water away from the bath. Furthermore, in a wet-chemical deposition process, where there also exists a need to rinse the wet-chemicals from the device, the active rinse shield provides a means for pre-rinsing within the electrofill chamber without chemical bath dilution. A pre-rinse will control defects on the deposition surface before deposition. For example, during a PVD process, a thin seed layer of copper may be deposited. Any existing contaminants on the wafer surface will cause a resistance to wetting. The active rinse shield allows an in-situ pre-rinse that helps eliminate contaminants on the wafer surface.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for shielding an electrofill chemical bath from a fluid rinse treatment of a semiconductor wafer, said wafer situated over said bath during said rinse, said method comprising:

attaching a shield over said bath, said shield having a frame with a pivot axis and a plurality of overlapping, interlocking blades connected to said pivot axis;

connecting a mechanical actuator having an actuator arm to at least one of said plurality of overlapping, interlocking blades through said pivot axis; and closing said shield by subjecting all of said plurality of overlapping blades to rotation by interlocking an upper ledge traversing the length of each lower blade with a lower ledge traversing the length of each adjacent upper blade in a first direction over said bath, such that when fully rotated, said upper ledges are in peripheral contact with said lower ledges sealing said shield and blocking rinse water from falling into said chemical bath, said closing rotation performed by rotating a pivot boss at a pivot point of each blade that interacts with a pivot interlock cut on each adjacent blade;

applying said rinse to said wafer;

redirecting said rinse by exposing angled blade ledges to said rinse;

draining said fluid off said shield for subsequent collection; and opening said shield by subjecting all of said plurality of overlapping, interlocking blades to rotation in a direction opposite said first direction such that said blades stack upon each other on one side of said frame; said opening rotation performed by rotating a pivot boss at a pivot point of each blade that interacts with a pivot interlock cut on each adjacent blade.

2. The method of claim 1 wherein said rotating said plurality of overlapping, interlocking blades further comprises activating said mechanical actuator to extend or retract said actuator arm linearly, moving rotationally said pivot axis.

3. A method for shielding an electrofill chemical bath from a fluid rinse treatment of a semiconductor wafer, said method comprising:

attaching a rinse shield over said bath;

closing said rinse shield during a rinse portion of said treatment by interlocking an upper ledge traversing the length of each lower blade with a lower ledge traversing the length of each adjacent upper blade in a first direction over said bath, such that when fully rotated, said upper ledges are in peripheral contact with said lower ledges sealing said shield and blocking rinse water from falling into said chemical bath, said closing performed by rotating a pivot boss at a pivot point of each blade that interacts with a pivot interlock cut on each adjacent blade; and deflecting and redirecting rinse spray away from said chemical bath by exposing angled blade ledges to said rinse spray.

4. The method of claim 3 wherein closing said rinse shield includes closing a plurality of overlapping blades.

5. The method of claim 4 including actuating said plurality of overlapping blades around a common pivot axis or single rotation point, rotating said blades to an extended position for bath coverage and to a retracted position for said wafer to pass by.

6. The method of claim 4 including actuating said blades by moving an initial or top blade from a closed-to-open or open-to-closed position.

7. The method of claim 4 including providing translational motion to said blades by interconnecting said initial or top blade to an adjacent blade by keyed grooves in said blades.

8. The method of claim 7 including interconnected each adjacent blade to one another by keyed grooves in said blades.

* * * * *